United States Patent [19]

Carpenter

[11] 4,354,647

[45] Oct. 19, 1982

[54] MINIATURE COLLAPSIBLE KITE AND METHOD OF MAKING SAME

[76] Inventor: Lindell O. Carpenter, 522 Glen Oaks Blvd., Dallas, Tex. 75232

[21] Appl. No.: 131,634

[22] Filed: Mar. 19, 1980

[51] Int. Cl.[3] ..... A63H 27/08

[52] U.S. Cl. ..... 244/153 R; 46/76 R; 46/79

[58] Field of Search ..... 244/153 R, 154, 16; 46/1 L, 79, 80, 51, 77, 30, 76 R, 74 R; D21/88, 89

[56] References Cited

U.S. PATENT DOCUMENTS

| | | | |
|---|---|---|---|
| 1,318,447 | 10/1919 | Hopkins | 46/79 |
| 2,168,653 | 8/1939 | Meacher, Jr. | 46/79 |
| 2,588,293 | 4/1952 | Roe | 244/153 R |
| 2,811,327 | 10/1957 | Roe | 244/153 R |
| 3,540,149 | 11/1970 | Lowe | 46/79 |
| 3,854,682 | 12/1974 | Lindenbaum | 244/154 |
| 3,885,343 | 5/1975 | Fields | 46/79 |
| 4,029,273 | 6/1977 | Christoffel, Jr. | 244/153 R |

FOREIGN PATENT DOCUMENTS

| | | | |
|---|---|---|---|
| 50-81604 | 1/1975 | Japan | 244/153 R |
| 239399 | 9/1925 | United Kingdom | 46/76 R |
| 906734 | 9/1962 | United Kingdom | 46/79 |

*Primary Examiner*—Trygve M. Blix
*Assistant Examiner*—C. T. Bartz
*Attorney, Agent, or Firm*—Thomas D. Copeland

[57] ABSTRACT

This miniature, but fully operable kite is made of a starter piece of thin material in a accordion style of construction, and when the starter piece is collapsed to its minimum dimension, in one embodiment, it is substantially circular in shape and is small enough to fit into and under the bottom of a typical paper drinking cup. In another embodiment, the starter piece is rectangular or is rectangular initially but may include partially cut out circular pieces that are punched out manually to form the starter piece comprised of a plurality of generally circular disks.

13 Claims, 17 Drawing Figures

MINIATURE COLLAPSIBLE KITE AND METHOD OF MAKING SAME

BACKGROUND OF THE INVENTION (1) Field of Invention

This invention relates to the field of games, toys, and amusement devices, and to the method of making such devices.

(2) Description of the Prior Art

The prior art relating to kites, and to kites of various sizes and shapes is very substantial, however, except for the applicant's own endeavors, it is not believed that the prior art has produced a kite of the extremely small dimensions disclosed herein, which dimensions are believed smaller by orders of magnitudes than "small" kites of prior inventors. It is customary in prior art kites to attach the pull string by running it thru two spaced locations on the kite cross members and then tying it away from the kite to give a large triangular connection to stabilize the kite in flight. However, with a miniature kite of this extremely small dimension it becomes very difficult to take this type of hitch up; whereas in this invention a single thread can be attached to a single hole with a needle or otherwise and thru the medium of the yoke 13, the same type stability is obtained in miniature kites.

SUMMARY OF THE INVENTION

The primary object of this invention is to provide a simple, easy to use, economical and yet durable and fully operable kite of very minute dimensions that may be collapsed for storage to a size of the order of a silver dollar, or similar monetary coin.

Another object is to provide a reproducible method of erecting this kite that is virtually "fool-proof" to produce and easy to construct and easy to operate miniature kite that will appeal to children of all ages.

A further object is to provide a kite erection method which starts with a series of thin substantially circular or rectangular and attached together disks or blocks of paper or similar semi-flexible material that are folded into stacks for storage and are unfolded to provide detachable sectors for final construction of the kite.

And, another object of this invention is to provide a kite made of thin paper that includes built in reinforcements that add to its controllability and prevent its collapse and add to its longevity.

An additional object is to provide a light-weight kite that is completely formed of paper materials including the tail and wherein the several separate pieces that form the complete kite assembly are all from paper stock, and wherein all of the joints for attaching the pieces are paper joints that are integral with the pieces thus connected, and require no adhesives.

And yet another object is to provide a small kite made of thin paper wherein the towing hitch or yoke is also made of paper and may also be integral with the piece from which it is formed. This yoke 13, is extremely important to the operation of this kite, in that by a single connection to the novel yoke it provides a stability equivalent to that obtained by the three point string attachment of larger kites. Further, it is extremely difficult for small kids to tie a small thread in the fashion necessary to produce the conventional stabilizer loop to form the pulling and control member for a miniature kite.

A still further object of this invention is to provide an integral paper brace or rib in the most flexible portion of the wing section of this thin paper kite.

DESCRIPTION OF THE PREFERRED EMBODIMENTS

Figure 2:
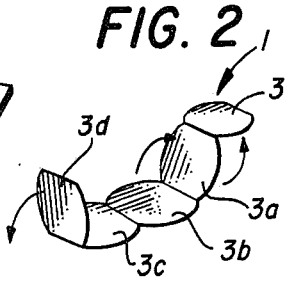
FIG. 2 is a pictorial view of the starter piece being unfolded from its stowed position of FIG. 1 into the flat lay-out mode shown in FIG. 3.
Figure 3:
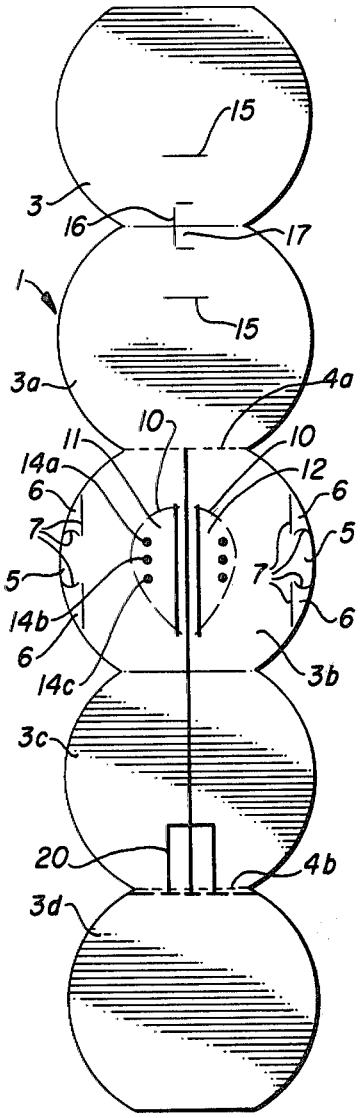
FIG. 3 is a plan view of one side of the starter piece of FIGS. 1 and 2.
Figure 4:
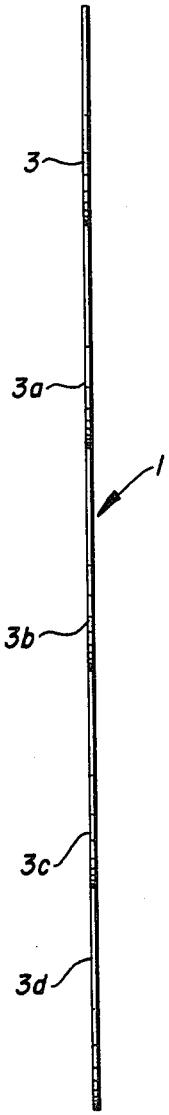
FIG. 4 is an elevational view taken at right angles to the starter piece of FIG. 3.
Figure 5:
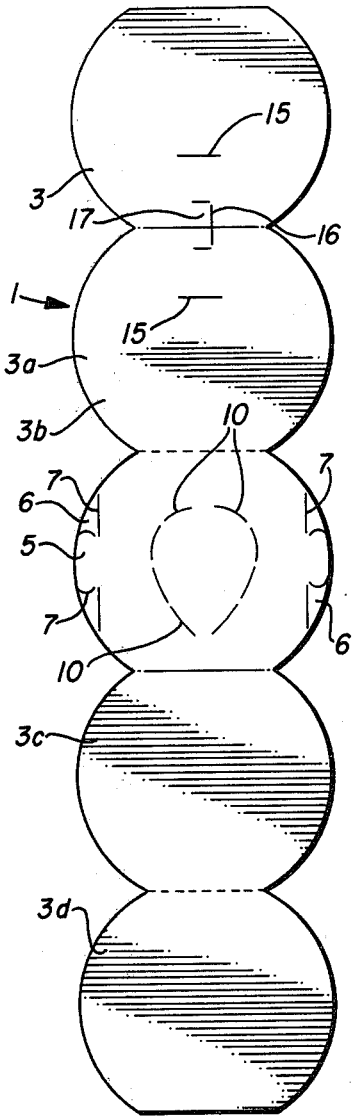
FIG. 5 is a plan view of the opposite side to that shown in FIG. 3.
Figure 8:
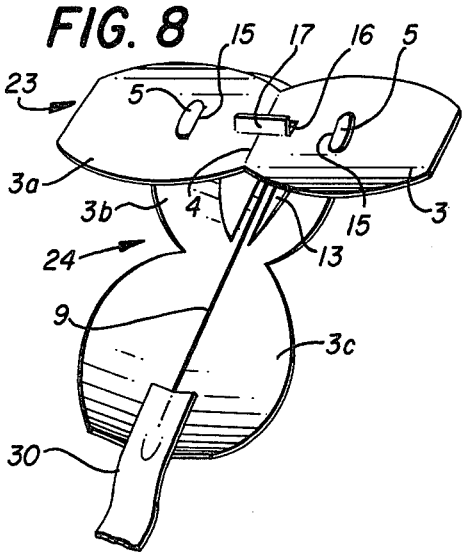
FIG. 8 is a perspective view taken from above the assembled kite.
Figure 9:
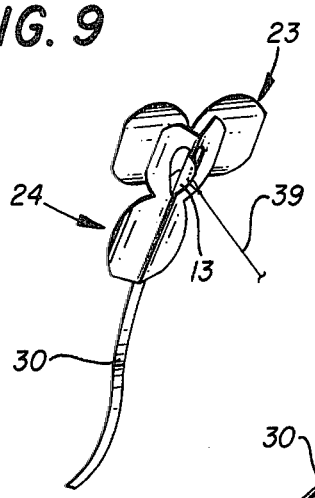
FIG. 9 is a pictorial view of the complete kite assembly in flight.
Figure 10:
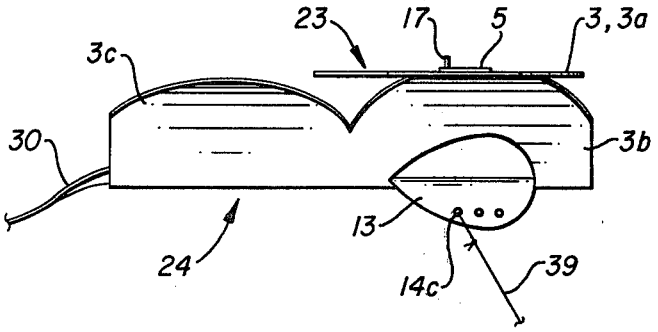
FIG. 10 is a side elevational view of the assembled kite of FIG. 8.
Figure 11:
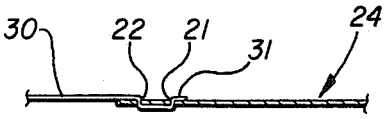
FIG. 11 is an end or side detail view showing the technique by which the long thin paper tail is attached to the paper body section of the assembled kite of FIG. 8.
Figure 14:
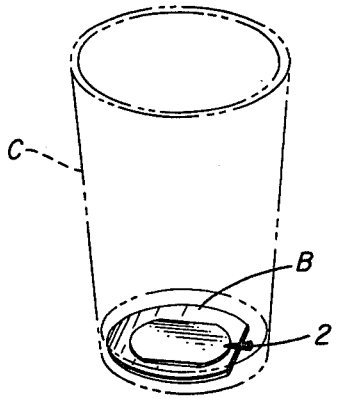
FIG. 14 is a pictorial presentation showing how the collapsed kite package may be inserted into a typical paper drinking cup.

In one embodiment, the concept of this invention is to provide a collapsible kite starter, which in this instance, comprises five identically shaped discs connnected together in serial fashion as seen in FIGS. 3–5, piece 1 that can be folded to together in semi-accordian style as shown in FIG. 2 to a coin size stack 2 of individual connected substantially circular disks 3 (after removing fron rectangular blocks 3Z) that can be fitted into the bottom external cavity of a typical paper drinking cup "C" as shown in phantom outline in FIG. 14, and wherein said stack 2 can be easily removed from the drinking cup and transformed into a satisfactorily operable miniature kite as shown in FIGS. 8–10.

Figure 1B:
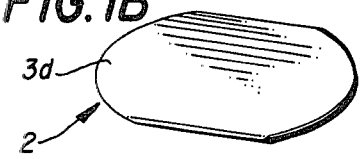
FIG. 1 is a perspective view taken above the collapsed starter piece of the kite of this invention.
FIG. 1A shows the blocks in one initial form of rectangular configuration before the optional separation (if severed) into the generally circular disks of FIG. 1B.
Figure 1A:
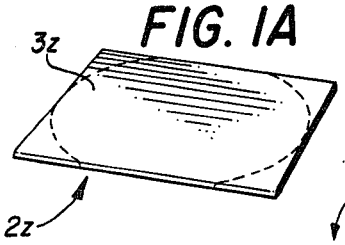

FIG. 1 actually represents either a two step sequence of one embodiment, i.e., (1) the initial forming of rectangular blocks 3Z of FIG. 1A with slits cut in to permit (2) serration of the peripheral material to provide the circular disk 3 configuration of FIG. 1B; or it alternately represents a rectangular block starter piece 2Z that is not subject to serration.

Figure 7:
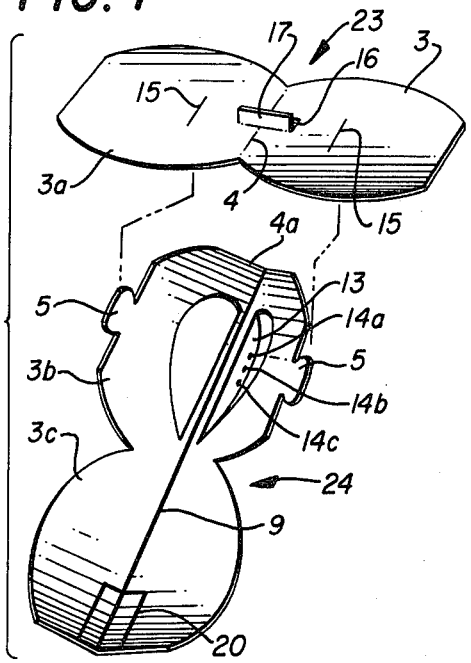
FIG. 7 is an exploded view showing how two of the major segments are to be attached in the construction of this kite.

In FIGS. 3 and 4 it will be seen that the substantially circular disks 3 that make up the starter piece 1, are each joined to its adjacent disk along a horizontal divider line 4, 4*a* or 4*b*. In the preferred embodiment, only five disks 3 are employed, so that at the time of construction of the kite the top two disks 3 and 3*a* will be separated as a unit by tearing gently along divider line 4*a*. And, disks 3*b* and 3*c* will similarly be torn from disk 3*d* at divider line 4*b*. The small tabs 5 will be formed at the sides of disk 3*b* by gently tearing away and discarding the small fillets 6 adjacent the tabs 5. The lines 7 that outline the tabs 5 and the fillets 6 are partly cut into the paper stock of the starter piece 1, so that they may be easily peeled off. Similarly the lines 10 near the center of disk 3*b* are partly cut thru the paper stock so that the two yoke flaps 11 may be easily punched out along lines 10 and folded about lines 12 to form a completed yoke 13 (FIGS. 7, 9, and 13) to receive the sewing thread that comprises the pulling medium for this very small, very light kite. Each yoke flap 11 includes three small dots 14*a*, 14*b*, and 14*c*, imprinted thereon, which may be punched out with a pencil point to form holes as desired to accommodate existing weather conditions. For example, the thread will be inserted thru both holes 14*a* if there is a light breeze, and will be inserted thru holes 14*b* if there is a medium wind and thru holes 14*c* if there is a strong wind. The thread or line 39 may be inserted via a sewing needle or with a pencil point or similar instrument as hole 14 is being pierced. flaps 11 are folded together below the body they form yoke 13 which, as seen in FIGS. 7 & 10, is the structure that connects the thread 39 to the kite body section 24 and hence to the kite itself.

Disks 3 and 3*a* include parallel slits 15 and a U-shaped slit 16 that crosses the divider line 4 between the disks. Slit 16 defines a brace or rib 17 when folded up as shown in FIG. 8. This reinforcing rib has been found to be extremely helpful in preventing a partial collapse of wing section 23 under certain flying conditions; which happening would further adversely affect the flight of the kite, or the control thereof.

The tail 30 may be glued or otherwise attached to the area outlined by line 20. Also, alternately, the tail itself may be folded under the stack 2, or may be omitted entirely with instructions to the user to make the specified small width tail to a specified length and tape or glue the top of the tail to the area so reserved.

FIG. 5 is the flip side of the starter piece 1 of FIG. 3 and of the previous lines and slits of FIG. 3, only the slits show thru. Decorative or advertising graphics may be included on this side of the starter piece 1.

Figure 6:
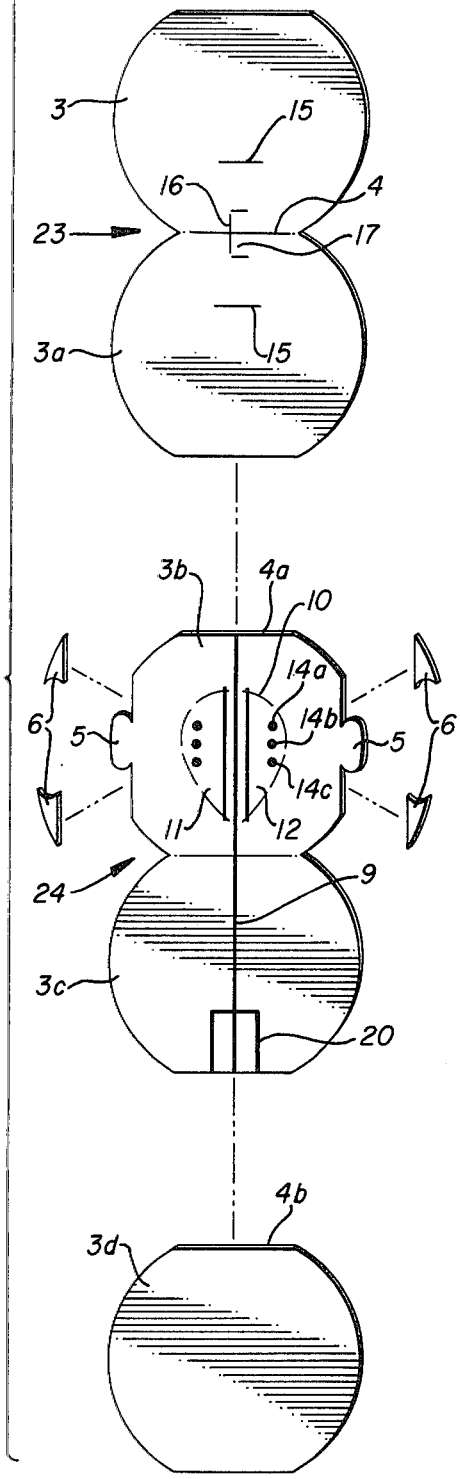
FIG. 6 is a plan view as in FIG. 3, wherein the starter piece has been split into three major segments or sections.

FIG. 6 shows a section 23 comprising disks 3 and 3*a* including slits 15 and 16 and divider line 4, all for the purposes described. Directly below section 23 in exploded view fashion is section 24 comprising parts already identified. And, directly below section 24 in exploded view fashion is disk 3*d*, which at the proper time may be discarded. However, for a time disk 3*d* will be retained since it includes the following written instructions on assembling this kite:

"(1) Tear apart at lines 4*a* and 4*b*.

(2) Fold on body center line 9.

(3) Fold yoke flaps 11 outward on lines 12 to form yoke structure 13.

(4) Insert tabs 5 into slits 15 of wing section 23 and fold flat against disks 3 and 3*a*.

(5) Punch out dots 14*a*, 14*b*, or 14*c* in descending order as the intensity of the wind increases.

(6) Insert end of a spool of thread thru the desired hole 14.

(7) Fold and insert tabs 31 of tail 30 thru slits 22 (FIG. 12) & 21 respectively. A portion of tail 30 will be trapped between slits 22 and 21 for holding purposes after the tabs 31 have been folded flat against disk 3*c*.

(8) Alternatively, tail 30 may be made by the user and simply taped or glued to the area defined by line 20.

(9) Punch out slit 16 and fold back to form support brace 17."

FIG. 7 shows the method of assembling what will become the wing section 23 to the now folded body section 24. The instructions on disk 3*d* said to fold the body section 24 along line 9. When the tabs 5 have been moved by the folding action along line 9 until the tabs line up with slits 15, they (the tabs 5) are inserted thru the slits and folded flat against section 23 as shown in FIG. 8.

In FIG. 10 and to some extent in FIG. 7, it will be seen that yokes 11 are punched out of section 24 and folded until they touch below the body section 24, to provide a braced support to receive the thread thru the proper hole 14*a*–*c* to satisfy the prevailing wind conditions.

Figure 12:
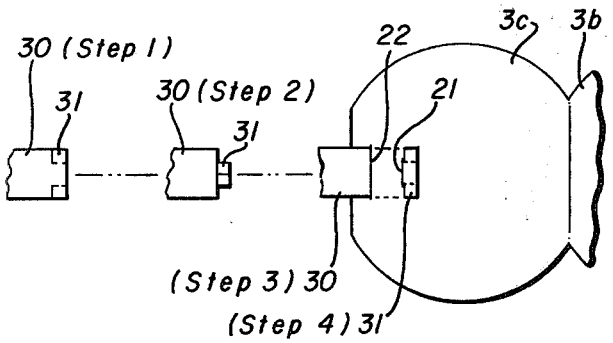
FIG. 12 is an enlarged detail exploded plan view of the structure of FIG. 11 for attaching the tail to this kite without adhesives.
Figure 13A:
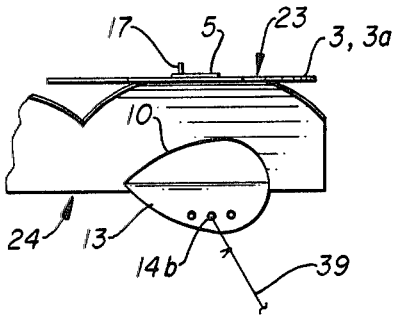
FIGS. 13A, B, and C, are enlarged detail views of three embodiments of the yoke construction employed in this invention.
Figure 13B:
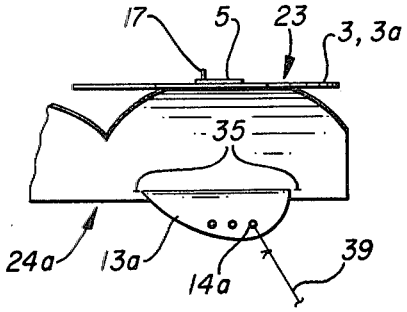

Another embodiment uses undetached rectangular blocks in place of circular disks, but the important features common to all embodiments are the yoke structures shown in detail in FIG. 13, the non-adhesive joining of the tail in FIG. 12, and the reinforcing brace or rib 17 that deters or prevents wing collapse in this miniature kite.

The details of the construction that permit the thin material tail 30 to be affixed to body disk 3*c* will be seen more clearly in FIG. 12. The upper end of tail 30 is cut from each side to form the tabs 31 which are folded in to permit them to pass thru both the full width slit 22 and the reduced width slit 21. After passing thru slit 21 the tabs 31 are then folded flat or nearly so against the disk 3*c*.

Figure 13C:
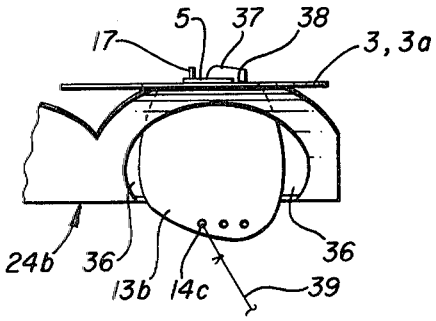

Details of the construction of the three different embodiments of the yoke structure 13 are seen in FIG. 13 to be the yoke 13 as described hereinbefore, and the separate piece yoke 13*a* which slips thru slits 35 on each side of a body section 24*a* and is then folded together at its free ends. The single thread 39 connection secures the yoke into a complete operating member. In the third embodiment of FIG. 13*c*, the yoke is also a separate member that is attached directly to the flat wing section 23*a* and by-passes the body section 24*b* thru an opening 36 therein and includes tabs 37 that engage slits 38 prior to being flattened against the far side of wing section 23*a*.

FIG. 14 shows a phantom outline of a typical paper drinking cup C that has a recessed bottom into which is inserted the collapsed kite package 2, after which a bottom cap B is pressed into place in the bottom cavity to hold the kite package in place until ready for removal and use. Cap B is easily removed by one's fingers to expose and release the kite package 2.

The methods and structures disclosed and illustrated herein are representative of but not limiting to the scope of the invention as defined in the following claims and including equivalents thereof.

What is claimed is:

1. A strip of thin continuous material for making a miniature kite which comprises a plurality of paper disks connected in serial fashion and adapted to fold one over another in accordian fashion until the entire assembly forms a thin generally circular package of a size on the order of a large monetary coin, and wherein one of said disks includes a punch thru yoke structure that folds outward to provide a reinforced terminal to stabilize the kite in flight.

2. A strip of thin continuous material comprising disks as in claim 1 wherein one side of at least one disk is adapted to receive decorations and/or advertising matter, and whereas the opposite side of at least one disk is reserved for instructions as to the method of assembly of the kite.

3. A reproducible method of making a kite without tools and without adhesives comprising the steps of:

a. forming a single strip of thin continuous material into a series of identically sized and shaped blocks with a horizontal fold line between each block, with a U-shaped partial cut-out across one fold line between a particular pair in a set of adjacent blocks, each one of the pair having a slit parallel to said fold line on adjacent sides of said U-shaped cut out, and with a pair of partial cut out flaps and partially cut out fillets on a block of a second set of blocks adjacent each other, and b. separating said series into segments of pluralities of said blocks by tearing certain blocks apart at their fold lines to form a wing section of said particular pair of blocks, and by tearing certain other blocks, one of which contains said flaps and fillets to form a body section of said second set of blocks, and c. punching out said fillets to leave tabs on one block of said second set of blocks and punching out said flaps thereon, and d. folding said body section longitudinally and transverse to its fold line to form a V-shaped kite body section, and e. inserting said tabs through said slits in adjacent unseparated blocks of said particular pair to combine the body and wing sections, and f. folding back said U-shaped cut out to form a reinforcing brace for the wing section, and g. folding said flaps together below the kite body to form a yoke for receiving a line for pulling and controlling said kite.

4. A construction unit for making a kite, comprising:

a. a single strip of continuous material, b. wherein said material is configured to define a series of identically shaped blocks, c. wherein a fold line separates each block, d. wherein certain adjacent blocks include slits paralleling the fold line between said adjacent blocks, e. wherein certain other adjacent blocks include fillets to be removed to expose tabs and include partial cut out areas to define flaps, f. means for separating said certain adjacent blocks from said certain other adjacent blocks, whereupon said certain other adjacent blocks are adapted to be folded longitudinally across their fold line whereby the tabs thereon are made to line up with and be inserted in said slits in said certain adjacent blocks to thereby define a kite body and wing section, and g. wherein said flaps are adapted to be folded together to form a yoke for receiving a line for control of said kite.

5. A construction unit as in claim 4, wherein at least one of said blocks includes printed instructions for erection of said kite.

6. A construction unit as in claim 4, wherein said certain adjacent blocks define a U-shaped slit across their fold line for folding out to define a wing brace.

7. A kite as in claim 4 wherein said blocks are generally circular in configuration and of a size of the order of a monetary coin, and include opposed flats on the circumstance, whereby the individual blocks may be folded one over another in accordian fashion so that the completed folded assembly may fit into the cavity under the bottom of a typical paper drinking cup.

8. A construction kit for making a kite assembly comprising a construction unit as in claim 4, and a second single strip of continuous material much narrower than the first said strip for non-adhesive attachment to said kite body to comprise the tail therefor.

9. A construction unit as in claim 4, wherein said blocks are so dimensioned that when folded along said fold line in accordian style, they collapse into a stack of a convenient size for handling and storage.

10. A construction unit as in claim 9 wherein the overall size is such that said stack is insertable under and into the bottom of a conventional disposable drinking cup.

11. A kite comprising:

a. identically externally shaped and dimensioned and attached wing and body section parts of the same material, initially folded together in accordian fashion to the size of a large monetary coin, b. non-adhesive paper joints connecting said wing and body sections when said body section is folded longitudinally and said wing section is detached and placed transversely thereto, c. a tail of the same material as the wing and body sections attached to said body by a non-adhesive paper joint, and d. a dual flap yoke integral with said body section and extending downward therefrom and having multiple line attachment locations therein extending in a longitudinal direction of the body to accommodate various wing conditions.

12. A kite as in claim 11 wherein each of said wing and body section parts comprises two identically sized generally circular disks.

13. In combination, a drinking cup having a side wall and a bottom with a downward facing cavity, and a miniature flyable toy kite construction unit as in claim 4, adjacent to the underside of said bottom and within the outline of said cavity, and cap means to removably hold said toy kite in place under the bottom of said cup.

* * * * *